US010777935B2

(12) United States Patent
Zugelder et al.

(10) Patent No.: US 10,777,935 B2
(45) Date of Patent: Sep. 15, 2020

(54) POTHEAD RETAINING SLEEVE SYSTEM, APPARATUS AND METHOD

(71) Applicant: Halliburton Energy Services, Inc., Houston, TX (US)

(72) Inventors: Adam Michael Zugelder, Claremore, OK (US); Jeffrey G. Frey, Broken Arrow, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/469,077

(22) PCT Filed: Jan. 31, 2018

(86) PCT No.: PCT/US2018/016313
§ 371 (c)(1),
(2) Date: Jun. 12, 2019

(87) PCT Pub. No.: WO2018/144647
PCT Pub. Date: Aug. 9, 2018

(65) Prior Publication Data

US 2020/0083636 A1 Mar. 12, 2020

Related U.S. Application Data

(60) Provisional application No. 62/455,410, filed on Feb. 6, 2017.

(51) Int. Cl.
*H01R 13/523* (2006.01)
*E21B 17/02* (2006.01)
(Continued)

(52) U.S. Cl.
CPC ..... *H01R 13/523* (2013.01); *E21B 17/028* (2013.01); *E21B 43/128* (2013.01); *H01R 13/631* (2013.01); *H01R 43/005* (2013.01)

(58) Field of Classification Search
CPC ..... H01R 13/6315; H01R 13/523; H01R 13/631; H01R 43/005; E21B 17/028; E21B 43/128
(Continued)

(56) References Cited

U.S. PATENT DOCUMENTS 2,158,472 A * 5/1939 Mendenhall ..... G05D 9/12 318/482
2,906,809 A * 9/1959 Drenning ..... H01B 17/306 174/73.1
(Continued)

FOREIGN PATENT DOCUMENTS

KR 200449411 Y1 7/2010

OTHER PUBLICATIONS

PCT Application Serial No. PCT/US2018/016313, International Search Report, dated May 10, 2018, 3 pages.
PCT Application Serial No. PCT/US2018/016313, International Written Opinion, dated May 10, 2018, 8 pages.

*Primary Examiner* — Gary F Paumen
(74) *Attorney, Agent, or Firm* — Gilliam IP PLLC

(57) ABSTRACT

A pothead retaining sleeve apparatus, system and method. An electric submersible (ESP) motor pothead includes pivotable retaining sleeves, each pivotable retaining sleeve including a ball that seats within a socket inside the pothead, the ball rotatable in the socket such that each pivotable retaining sleeve is independently moveable around a spheroidal joint formed by the ball and socket. An ESP motor pothead system includes a pothead for electrically connecting a power cable to an electric submersible motor, each phase of the power cable extending through a retaining sleeve, the retaining sleeve extending through a conduit formed through an insulating block inside the pothead, the conduit including a spherical socket, the retaining sleeve including a tubular portion terminating at a ball seated
(Continued)

within the spherical socket to form a ball and socket joint, and the tubular portion rotatable around the ball and socket joint during tying off of the phases.

20 Claims, 14 Drawing Sheets

(51) Int. Cl.
*E21B 43/12* (2006.01)
*H01R 13/631* (2006.01)
*H01R 43/00* (2006.01)

(58) Field of Classification Search
USPC ..... 439/246
See application file for complete search history.

(56) References Cited

U.S. PATENT DOCUMENTS

| | | | | | |
|---|---|---|---|---|---|
| 2,999,998 | A * | 9/1961 | Cole | H01R 13/6315 | 439/252 |
| 5,334,035 | A * | 8/1994 | Wehrle | H01R 13/422 | 439/246 |
| 8,029,317 | B2 * | 10/2011 | Albers | E21B 17/023 | 439/589 |
| 2011/0130020 | A1 | 6/2011 | Costa et al. | | |
| 2011/0176941 | A1 | 7/2011 | Albers et al. | | |
| 2012/0052721 | A1 | 3/2012 | Watson | | |
| 2016/0093963 | A1 | 3/2016 | Streckewald | | |
| 2018/0090874 | A1 * | 3/2018 | Frey | H01R 43/005 | |
| 2018/0163728 | A1 * | 6/2018 | Zugelder | E21B 43/12 | |
| 2019/0072090 | A1 * | 3/2019 | Straub | F04C 2/101 | |

* cited by examiner

POTHEAD RETAINING SLEEVE SYSTEM, APPARATUS AND METHOD

BACKGROUND

1. Field of the Invention

Embodiments of the invention described herein pertain to the field of electric submersible motor power cable connections. More particularly, but not by way of limitation, one or more embodiments of the invention enable a pothead retaining sleeve system, apparatus and method.

2. Description of the Related Art

Fluid, such as natural gas, oil or water, is often located in underground formations. When pressure within a well is not enough to force fluid out of the well, the fluid must be pumped to the surface so that it can be collected, separated, refined, distributed and/or sold. Centrifugal pumps are typically used in electric submersible pump (ESP) applications for lifting well fluid to the surface. Centrifugal pumps accelerate a working fluid through a rotating impeller, which is driven by a rotating shaft.

The shaft's rotation is powered by an electrical motor typically located on an upstream side of a pump assembly. The motor is conventionally a two-pole, three-phase squirrel cage induction motor. The ESP power source is located at the surface of the well and is connected to the motor by insulated electrical conductors that extend up to thousands of feet alongside the ESP assembly down into the wellbore. A motor lead extension (MLE) cable, also referred to as a motor flat, is a low-profile cable that is spliced to the lower end of the main power cable, banded to the side of the ESP pump and seal-chamber section, and has a male termination for plugging or splicing into the motor electrical connection. An MLE typically has three leads or "phases." At a connection point to the motor, the MLE phases extend through a protected electrical connector that engages with an electrical receptacle on the motor. The electrical connector is sometimes referred to in the art as a "pothead," named after the potted or encapsulated conductors inside the electrical connector.

Well fluid should not contact the motor's electrical cables or electrical connections to avoid failure of the cables providing power to the motor. Failure of the power cables may cause inadequate power to the motor and failure of the motor. A conventional pothead includes a corrosion-resistant steel body filled with a number of insulating materials used within, including, for example, Polyether Ether Ketone (PEEK), an opaque organic thermoplastic polymer, which insulates the motor's electrical connections. FIG. 1 illustrates a cross section of a pothead of the prior art. Conventional pothead 100 may be made of lead in order to prevent harmful gas such as $H_2S$ from permeating into motor electrical connections inside conventional pothead 100. Three conventional phases 105 are typically arranged inside conventional pothead 100. In any typical configuration, a conventional insulator 110 surrounds the phases to provide electrical integrity.

To install the power cable to the motor, the installer plugs each MLE phase into the connectors of the motor head, metal to metal. Next, the installer typically seals the connectors with insulating material such as polytetrafluoroethylene (PTFE) or the polyimide tape known as Kapton® (a registered trademark of E. I. du Pont de Nemours and Company of the United States). Finally, the installer pushes the connectors into the motor head and seals the connection. The installer inserts the ESP motor cables into conventional pothead 100 by pushing each conventional phase 105, one at a time, into conventional insulator 110 in conventional pothead 100. To make this process easier, pothead conventional insulator 110 has a conventional retaining sleeve 115 for each conventional phase 105. In addition to its insulating properties, conventional retaining sleeve 115 must be rigid to aid in pushing the phase connectors into the motor head.

While various embodiments of potheads offer different configurations for the three phases, all suffer from a lack of space between the respective retaining sleeves for the installer to connect and tape the phases. The space between the phases is at a premium and restricted to accommodate the size of the motor head and the size of the power cable, which is often limited by the size of the annulus surrounding the assembly. Further, at the end of the pothead installation process the installer must gather the phases together and wrap them in additional insulation to save space and form a single MLE. Therefore, the retaining sleeves must be very close together. Unfortunately, this results in the space between each sleeve being inadequate to allow for properly tying-off each phase. In an attempt to work around this problem, installers tend to bend the sleeves to the side, two at a time, to have room to tie off each phase. However, bending the phases in this manner creates stress points 120 in the insulators as shown in FIG. 1. Stress points 120 due to bending the rigid retaining sleeves create a potential for cracking, eventual cable damage and even cable failure over time. Where damage occurs to the insulator, the electrical connectors may be left vulnerable to ingress of unwanted fluids. Stress points 120 are particularly troublesome with multi-wire cable bundles.

As is apparent from the above, current electrical pothead connections do not provide sufficient space for an installer to tie-off the motor phases without risk of stress and/or damage to the phases and pothead insulator. Therefore, there is a need for an improved pothead retaining sleeve system, apparatus and method.

SUMMARY

A pothead retaining sleeve apparatus, system and method is described. Illustrative embodiments generally relate to a pothead pivoting retaining sleeve.

An illustrative embodiment of an electric submersible motor pothead includes a pair of insulating blocks including a first insulating block adjacent to a second insulating block, each pair of insulating blocks including a conduit for each phase of a plurality of phases of a power cable, each conduit including a socket formed partially by the first insulating block and partially by the second insulating block, a phase retaining sleeve extending through each conduit, the phase retaining sleeve including a ball seated in the socket and the phase retaining sleeve pivotable in the socket around the ball. In some embodiments, the phase retaining sleeve is pivotable by pitch, yaw and roll around the ball. In certain embodiments, the phase retaining sleeve further includes a tubular portion coupled to the ball, and a channel extending through the ball and the tubular portion of the retaining sleeve. In some embodiments, a power cable phase of the plurality of phases extends through the channel, the power cable phase powering an electric submersible motor. In some embodiments, the channel at a top of the ball includes a cutout around the power cable phase. In certain embodiments, each conduit further includes a tolerance extending from the socket, the tolerance accommodating angling of the phase retaining sleeve inside the pair of insulating blocks. In some embodiments, the tolerance includes a flared inner diameter of one of the first insulating block or the second insulating block. In certain embodiments, the tolerance includes a space around a tubular portion of the retaining sleeve. In some embodiments, each phase retaining sleeve is independently pivotable. In certain embodiments, the conduits are arranged in a triangular configuration and the pair of insulating blocks are round in cross-section. In some embodiments, the electric submersible motor pothead further includes a pothead housing, the pothead housing including a seal skirt extending below the pair of insulating blocks. In certain embodiments, the conduits are arranged in a side-by-side configuration and the pair of insulating blocks are elliptical.

An illustrative embodiment of an electric submersible motor pothead includes a plurality of pivotable retaining sleeves, each pivotable retaining sleeve of the plurality of pivoting retaining sleeves including a ball that seats within a socket inside the electric submersible motor pothead, the ball rotatable in the socket such that each pivotable retaining sleeve is independently moveable around a spheroidal joint formed by the ball and socket. In some embodiments, each pivotable retaining sleeve of the plurality of pivoting retaining sleeves further includes a tubular portion coupled to the ball, and a channel extending through an inside of the tubular portion and the ball, wherein a phase of a power cable extends through the channel before connecting to an electric submersible motor. In certain embodiments, the channel extending through the ball includes an outwardly extending cutout forming a clearance for the phase as the ball rotates in the socket. In some embodiments, there are three phases connected to the electric submersible motor and three pivotable retaining sleeves in the plurality of pivotable retaining sleeves. In certain embodiments, the socket is formed by at least one block inside a housing of the pothead, wherein phases of a power cable extend through conduits in the block. In certain embodiments, each socket forms a portion of the conduit. In some embodiments, the at least one block is made of an insulating material. In some embodiments, the at least one block is made of a steel. In certain embodiments, there are at least two blocks aligned to form each conduit, and each of the at least two blocks forms a portion of the socket.

An illustrative embodiment of an electric submersible motor pothead includes a pothead for electrically connecting a power cable to an electric submersible motor, the power cable including a plurality of phases, each phase of the plurality of phases extending through a retaining sleeve, the retaining sleeve extending through a conduit formed through an insulating block secured inside the pothead, the conduit including a substantially spherical socket, the retaining sleeve including a tubular portion and a ball at an end of the tubular portion, the ball seated within the substantially spherical socket to form a ball and socket joint, and the tubular portion rotatable inward and outward around the ball and socket joint during tying off of the plurality of phases. In some embodiments, each phase of the power cable includes a conductor surrounded by a cable insulation layer, wherein the conductor is electrically coupled to a conducting pin that plugs into an electric submersible motor. In certain embodiments, the electric submersible motor is downhole and is operable to turn an electric submersible pump, and wherein the power cable extends from a power source proximate a well surface to the electric submersible motor to provide power to the electric submersible motor. In some embodiments, the ball is a spherical segment, and the socket is rounded to mate with the spherical segment. In certain embodiments, a diameter of the spherical segment is larger than a diameter of the tubular portion. In some embodiments, wherein a ratio of the diameter of the spherical segment to the diameter of the tubular portion is 1.23:1 and the retaining sleeve is rotatable outwards up to 35°.

An illustrative embodiment of an electric submersible motor power cable insulating apparatus, the insulating apparatus fitting within a pothead, the apparatus including a plurality of pivoting insulating sleeves, each pivoting insulating sleeve including an axially oriented shaft for accepting a power cable phase of an electric submersible pump (ESP) power cable, includes a ball joint terminating one end of the axially oriented shaft, and a central conduit traversing the length of the axially oriented shaft and ball joint, the central conduit mateable with the power cable phase, a first insulating block having a plurality of pathway openings on a first face, each opening accommodating a pivoting insulating sleeve, and a second face opposite the first face, the second face including a portion of a spherical cavity accommodating a portion of the ball joint, the opening contiguous with the portion of the spherical cavity of the first insulating block to form a pathway through the first insulating block, and a second insulating block having a first face including a cable access opening accessing the pathway through the first insulating block and a second face opposite the first face, the second face including a portion of the spherical cavity that accommodates a remaining portion of the ball joint such that when the second face of the first insulating block and the second face of the second insulating block are joined, the two second faces form a spherical cavity mateable to the ball joint of the pivoting insulating sleeve. In some embodiments, each pivoting retaining sleeve rotates up to 35° from a longitudinal axis of the pothead within the pathway opening. In certain embodiments, the pathway opening is tapered.

An illustrative embodiment of a method of installing a three-phase power cable into an electric submersible pump (ESP) motor head, includes splicing the three-phase power cable to expose three separate phases, placing a terminating end of each phase, one at a time, into a central conduit of an upper insulator within a pothead, passing the each phase, one at a time, through a ball joint at one end of a pivoting retaining sleeve and continuing on through an axial portion of the pivoting retaining sleeve thereby passing through a lower insulator, creating a space to connect the terminating end of a first phase of the three separate phases to a terminal connector of the ESP motor head by bending the terminating ends of a second and third phase away from the first phase by pivoting the pivoting retaining sleeve up to 35° from a central axis passing through the center of the pivoting retaining sleeve, connecting the terminating end of the first phase to a terminal connector of the ESP motor head, tying the terminating end of the first phase to the terminal connector of the ESP motor head by wrapping the connection in insulating material, repeating creating a space, connecting and tying the terminating end steps for each of the second and third phases in turn until all three phases are tied to the ESP motor head, pushing the pothead into the motor head, and sealing the pothead to motor head connection.

In further embodiments, features from specific embodiments may be combined with features from other embodiments. For example, features from one embodiment may be combined with features from any of the other embodiments.

In further embodiments, additional features may be added to the specific embodiments described herein.

BRIEF DESCRIPTION OF THE DRAWINGS

Advantages of the present invention may become apparent to those skilled in the art with the benefit of the following detailed description and upon reference to the accompanying drawings in which.

Figure 1:
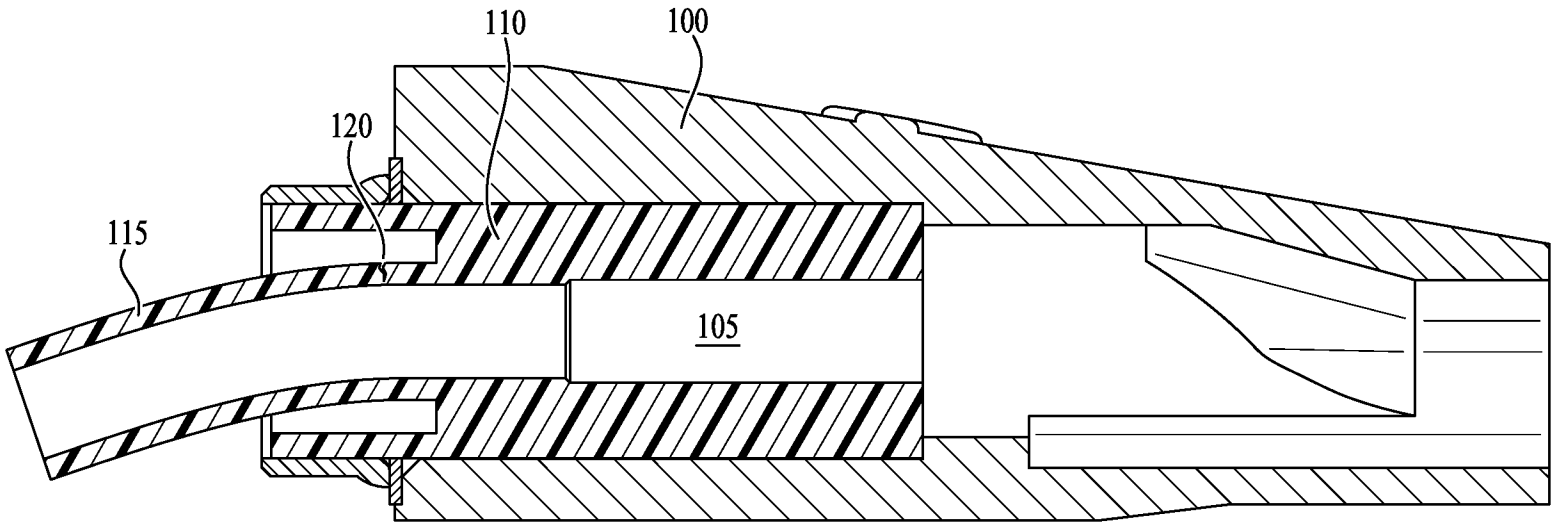
Fig. 1 PRIOR ART
FIG. 1 illustrates a cross-sectional view of a traditional insulator and prior art retaining sleeve of a conventional pothead.

While the invention is susceptible to various modifications and alternative forms, specific embodiments thereof are shown by way of example in the drawings and may herein be described in detail. The drawings may not be to scale. It should be understood, however, that the embodiments described herein and shown in the drawings are not intended to limit the invention to the particular form disclosed, but on the contrary, the intention is to cover all modifications, equivalents and alternatives falling within the scope of the present invention as defined by the appended claims.

DETAILED DESCRIPTION

A pothead retaining sleeve apparatus, system and method are described. In the following exemplary description, numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

As used in this specification and the appended claims, the singular forms "a", "an" and "the" include plural referents unless the context clearly dictates otherwise. Thus, for example, reference to a retaining sleeve includes one or more retaining sleeves.

"Coupled" refers to either a direct connection or an indirect connection (e.g., at least one intervening connection) between one or more objects or components. The phrase "directly attached" means a direct connection between objects or components.

"Downstream" refers to the longitudinal direction with the principal flow of lifted fluid through the wellbore when the pump assembly is in operation. By way of example but not limitation, in a vertical downhole electric submersible motor, the downstream direction may be towards the surface of the well.

"Upstream" refers to the longitudinal direction opposite the principal flow of lifted fluid through the wellbore when the pump assembly is in operation. By way of example but not limitation, in a vertical downhole electric submersible motor, the upstream direction may be opposite the surface of the well.

As used in this specification and the appended claims, with respect to a pothead assembly, the "bottom" of the pothead or a pothead component means the side of the pothead or pothead component closest to the motor when the pothead is installed, without regard to whether the well in which the pothead is installed is vertical, horizontal or extends through a radius.

As used in this specification and the appended claims, with respect to a pothead assembly, the "top" of the pothead or a pothead component means the side of the pothead or pothead component opposite the bottom of such pothead or pothead component.

As used herein, the term "outer," "outside" or "outward" means the radial direction away from the center of an electric submersible pump (ESP) power cable phase and/or the opening of a component through which the phase would extend. In the art, "outer diameter" and "outer circumference" are sometimes used equivalently. As used herein, the term outer diameter is used to describe what might otherwise be called the outer circumference or outer surface of a pothead component such as a retaining sleeve or insulator block.

As used herein, the term "inner", "inside" or "inward" means the radial direction toward the center of the ESP power cable phase and/or the opening of a component through which the phase would extend. In the art, "inner diameter" and "inner circumference" are sometimes used equivalently. As used herein, the term inner diameter is used to describe what might otherwise be called the inner circumference or inner surface of a pothead component such as a pothead housing or seal skirt, or the inner surface that forms a conduit through an insulating block.

As used herein the terms "axial", "axially", "longitudinal" and "longitudinally" refer interchangeably to the direction extending along the length of a pothead from bottom to top, or vice versa.

As used in this specification and the appended claims, "insulator block" or "insulating block" refer interchangeably to a block inside a pothead housing that surrounds the electrical connections' retaining sleeves inside the pothead. Although conventionally the "insulator block" or "insulating block" would have been made of an insulating material such as rubber or polyether ether ketone (PEEK), illustrative embodiments are not so limited and include an insulator block or insulating block made of corrosion resistant steel or another similar conductive material without regard to insulating properties.

For ease of description, the illustrative embodiments described herein are described in terms of an ESP assembly making use of a three-phase motor and power cable. However, the pothead of illustrative embodiments is not so limited and may be applied to any motor, with any number of phases, exposed to fluid and having a motor plug-in, splice-in, tape-in or similar electrical connection. For example, the retaining sleeve of the illustrative embodiments may be applied to submersible motors in axial-flow pumps, radial-flow pumps, mixed-flow pumps, horizontal surface pumps, and/or turbine regenerative type pumps and/or to electric motors operating other types of machines that may be submerged.

Illustrative embodiments provide a pivotable pothead retaining sleeve that terminates at a ball joint. Each retaining sleeve may be encased in a cylindrical space formed by an insulator, the space having a rounded socket. The ball joint of the retaining sleeve may rest in the socket. A power cable and/or power cable phase may extend through the retaining sleeve. The ball joint may pivot in the socket to permit the retaining sleeve to rotate and/or swivel around the ball joint without putting undesirable stress on the insulator or power cable. Illustrative embodiments may provide a pivoting retaining sleeve to improve installation of an ESP motor's electrical power without creating compressive force on the phases when an installer bends the phases to allow for proper tie-in. Illustrative embodiments may reduce or eliminate stress points and/or cracking of pothead insulation, which may reduce the instance of cable damage or failure. Illustrative embodiments may provide space and/or movement for an installer to tie-off the phases without risk of stress and/or damage to the phases and possibly cracking the insulators.

In a three-phase motor, such as an ESP induction motor, the three cable phases may be included in the pothead of one or more illustrative embodiments. For ease of description, the pothead of illustrative embodiments may be described in terms of enclosing three phases in either a side-by-side or round configuration, however, other configurations may be employed depending on the number and size of phases and space limitations.

Figure 2A:
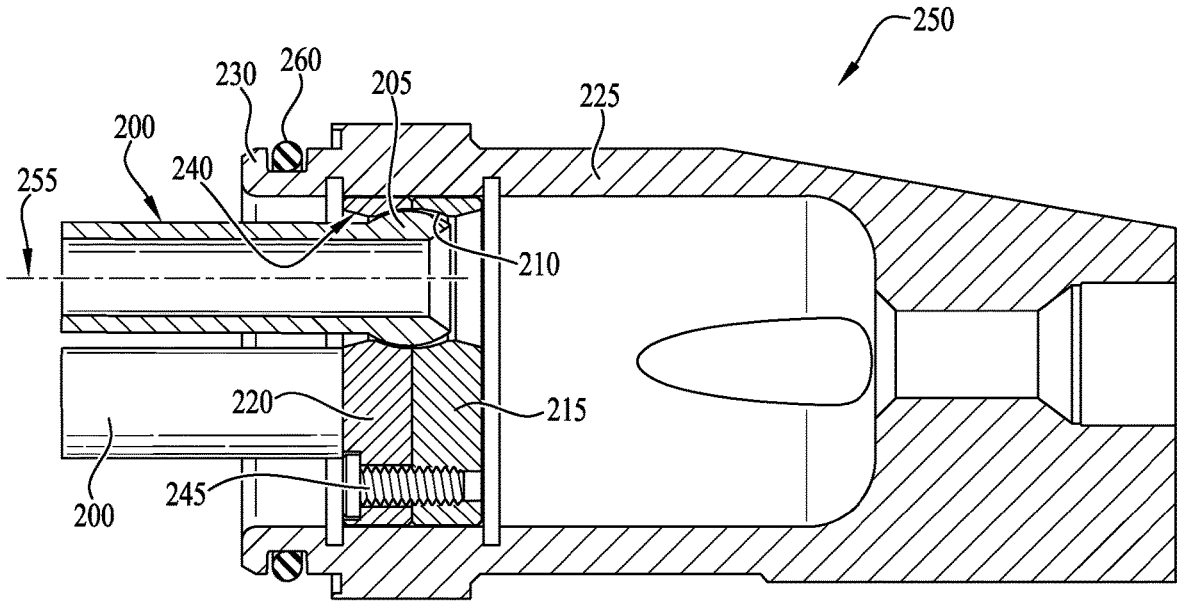
FIG. 2A is a cross-sectional view across line 2A-2A of FIG. 12 of an exemplary pothead assembly showing pivoting retaining sleeves of an illustrative embodiment in a round configuration.
Figure 2B:
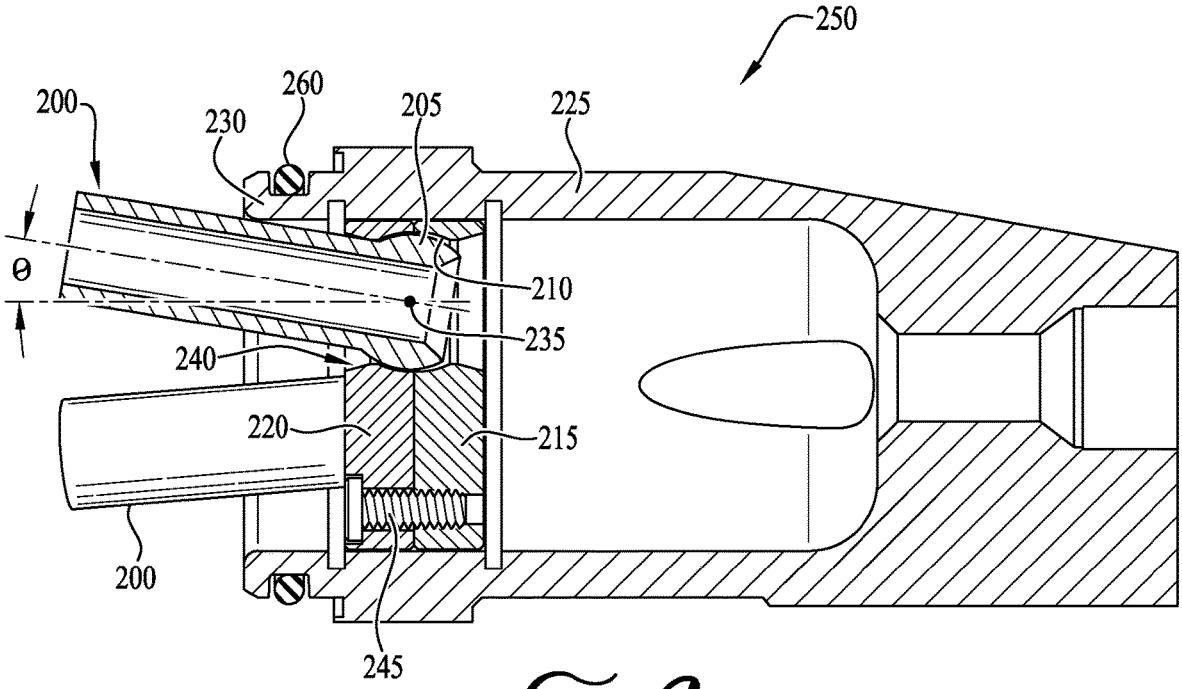
FIG. 2B is a cross-sectional view across line 2B-2B of FIG. 13 of an exemplary pothead assembly showing pivoting retaining sleeves of an illustrative embodiment pivoted outward.

FIG. 2A and FIG. 2B illustrate a pothead with pivoting retaining sleeves of an illustrative embodiment arranged in a round phase configuration. Retaining sleeve 200 may be tubular in shape with ball 205 on the upper side of sleeve 200. Ball 205 may generally be spherical in shape although ball 205 may not form a complete sphere, for example ball 205 may be a spherical segment, spheroid and/or ellipsoid. As shown in FIG. 2A and FIG. 2B, ball 205 is a spherical segment, cut by a plane at its top to allow phase 500 (shown in FIG. 5) to extend through ball 205, and cut by a plane at its bottom so as to be continuous with tubular portion 400 (shown in FIG. 4A). Socket 210 may be a two-part socket formed partially by upper insulating block 215 and partially by lower insulating block 220. Socket 210 may be a cavity generally spherical or ellipsoid in shape, but may not form a complete sphere and/or may be complementary to the shape of ball 205. Ball 205 and socket 210 may mate and/or be complementary in shape such that rounded portion of ball 205 rocks within rounded socket 210 as retaining sleeve 200 pivots, rotates, rolls and/or moves in the joint. Ball 205 of retaining sleeve 200 may sit within socket 210 and be rotatable and/or pivotable inside socket 210 to form pivotable retaining sleeve 200.

Housing 225 of pothead 250 may include seal skirt 230 that extends below lower insulating block 220. Seal skirt 230 may seal the motor connection from fluid ingress. In FIG. 2A, retaining sleeve 200 is shown parallel to longitudinal axis 255. In FIG. 2B, retaining sleeves 200 have been rotated outwards an angle θ around pivot point 235. Ball 205 and socket 210 joint may allow rotation around three axes (pitch, yaw and roll) about the common pivot point 235, although seal skirt 230 and/or lower insulating block 220 may restrict angle θ and/or the range of motion of retaining sleeve 200. As shown in FIG. 2B, seal skirt 230 may limit the rotation of retaining sleeve 200 inside socket 210 as retaining sleeve 200 rotates to abut the inner diameter of seal skirt 230 and/or the inner diameter of tolerance 240. Tolerance 240 may be an outward flare of the inner diameter of the conduit through lower insulating block 220, below socket 210, that accommodates angling of retaining sleeve 200 as shown in FIG. 2B. Screws 245 may compress upper insulating block 215 and lower insulating block 220 together. Upper insulating block 215 and/or lower insulating block 220 may be made of insulating material such as Polyether Ether Ketone (PEEK), rubber, ceramic, phenolic resin, thermal plastic or another similar insulating material. In some embodiments, upper insulating block 215 and/or lower insulating block 220 may be conductive and may be made of metal, such as steel.

Figure 3A:
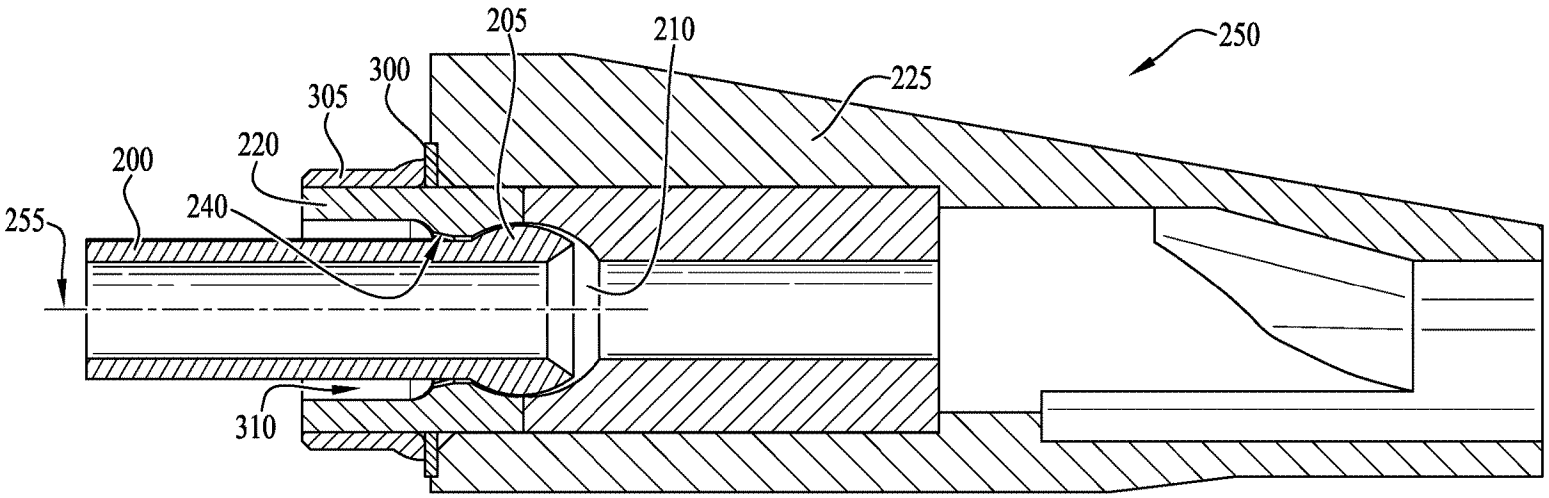
FIGS. 3A and 3B are cross-sectional views of an exemplary pothead assembly showing pivoting retaining sleeves of an illustrative embodiment in a side-by-side configuration.
Figure 3B:
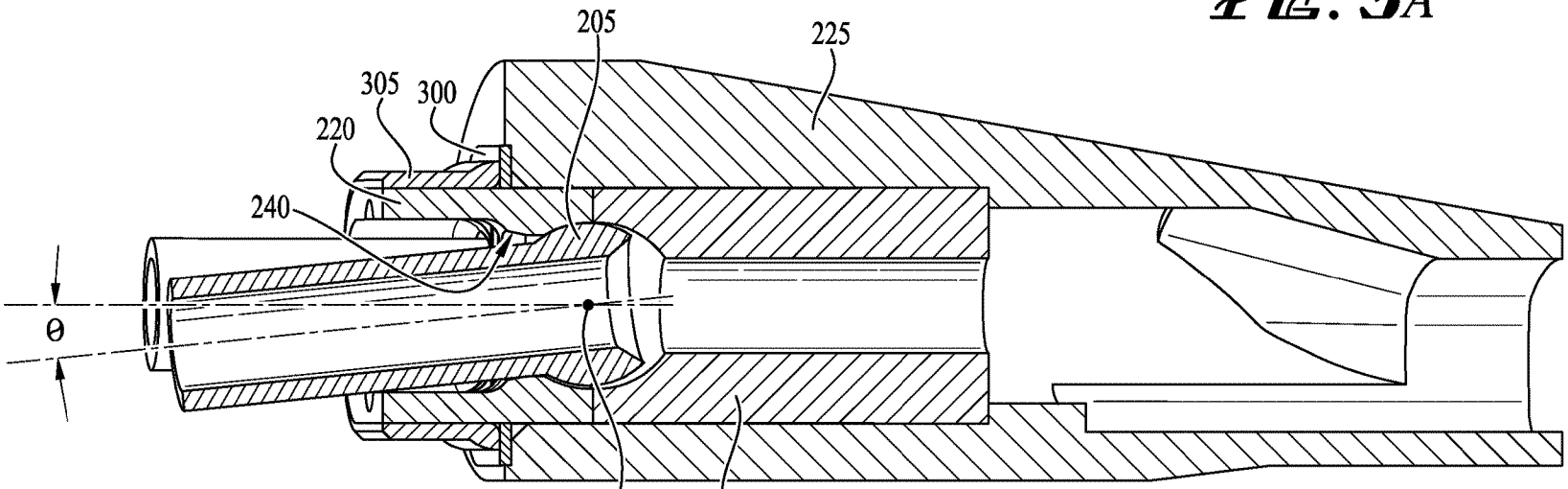

FIG. 3A and FIG. 3B illustrate a pothead with pivoting retaining sleeves of an illustrative embodiment showing a side-by-side (linear) phase configuration. Round and/or spherical socket 210 may be formed partially by upper insulating block 215 and partially by lower insulating block 220. For example, each insulating block 215, 220 may form half of socket 210 and/or spherical socket 210 may be formed ⅓ by a first insulating block and ⅔ by the second block. In certain embodiments, socket 210 may be formed in a single insulating block. Ball 205 of retaining sleeve 200 seats within socket 210 and may be pivotable and/or rotatable therein. In the example of FIG. 3A and FIG. 3B, lower insulator 220 extends beyond and/or below (lower than) pothead housing 225, and the lower insulator 220 may limit the maximum angle θ of rotation of retaining sleeve 200. A lead gasket 300 surrounded by an elastomeric boot 305, which may be a molded seal made of rubber such as ethylene propylene diene monomer (EPDM) or Aflas® (a registered trademark of Asahi Glass Co. of Japan), may seal the space between the outer diameter of lower insulator 220 and the inner diameter of housing 225. In FIG. 3A, retaining sleeves 200 are parallel to longitudinal axis 255. In FIG. 3B, the retaining sleeve 200 has been rotated outward an angle θ. The side-by-side embodiment of FIGS. 3A and 3B may be compared and contrasted with the round and/or triangular embodiment shown in FIGS. 2A and 2B.

Figure 4A:
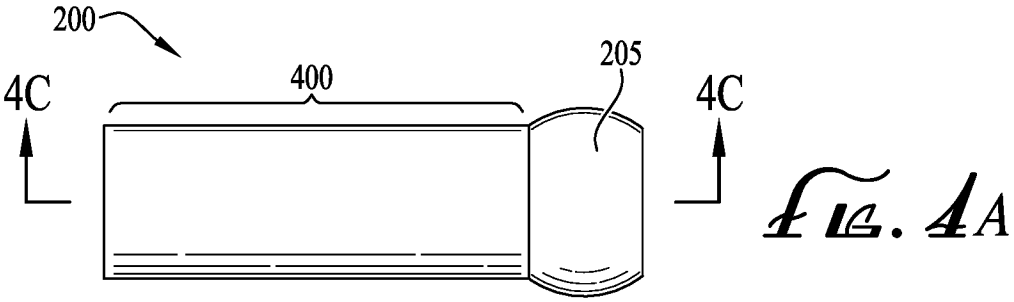
FIG. 4A illustrates a side view of a pivoting retaining sleeve of an illustrative embodiment.
Figure 4B:
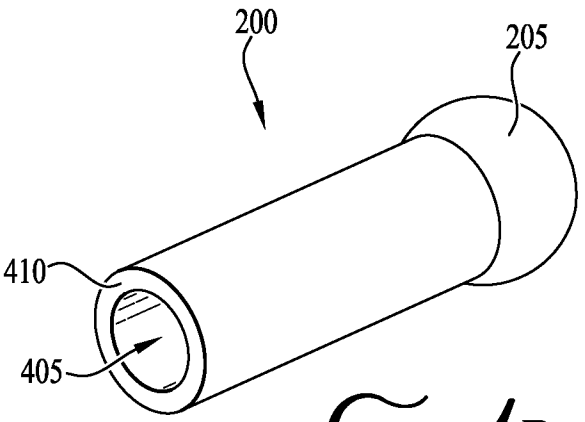
FIG. 4B illustrates an orthogonal view of a pivoting retaining sleeve of an illustrative embodiment.
Figure 4C:
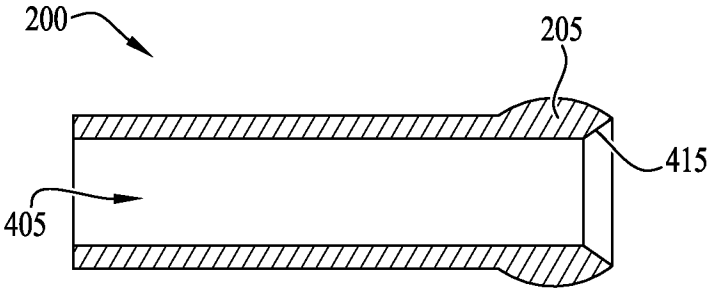
FIG. 4C is a cross sectional view across line 4C-4C of FIG. 4A of a pivoting retaining sleeve of an illustrative embodiment.

FIGS. 4A-4C illustrate a pivoting retaining sleeve of illustrative embodiments. Retaining sleeve 200 may generally be rigid and tubular in shape, and may be made of polyetheretherketone (PEEK), rubber, ceramic, phenolic, thermoplastic or another non-conductive material having similar properties. An end of sleeve 200 may include ball 205 that pivots within socket 210, to form a ball and socket and/or spheroidal joint. The ball and socket joint may permit retaining sleeve 200 with phase 500 (shown in FIG. 5) extending through retaining sleeve 200, to pivot during installation of phases 500 and connection of pothead assembly 250 to motor head 1700 (shown in FIG. 17A). Tubular portion 400 (body) of pivotable retaining sleeve 200 may be about ¾ (or 75%) of the length of retaining sleeve 200. Tubular portion 400 may be tubular, annular and/or shaped like a hollow cylinder. Ball joint 205 may form one end of pivoting retaining sleeve 200. Ball 205 may be a rounded, ellipsoid and/or spherical bulb and/or protrusion at one end of retaining sleeve 200.

Ball 205 may have a larger diameter than the diameter of tubular portion 400 such that ball 205 stays locked and/or does not slide out from socket 210. The ratio of the diameter of ball 205, the diameter of the sphere of which ball 205 forms a segment, and/or the largest diameter of ball 205 as compared to the diameter of tubular portion 400 may determine the angle, degrees and/or extent of pivot of retaining sleeve 200. For example, to achieve a 35° cone 800 (shown in FIG. 8) of movement, the ratio between the diameter of tubular portion to the diameter of ball 205 (e.g., the diameter of the sphere from which ball 205 is cut) is 1:1.23.

Axial opening 405 may extend the length of pivoting retaining sleeve 200 from tubular end 410 through ball 405. Axial opening 405 may terminate in a similarly sized opening in the base of ball joint 205, but include tapered cutout 415, and permit phase 500 to extend through the length of retaining sleeve 200. Illustrative embodiments may accommodate diameter variations in the power cables 1940 (shown in FIG. 19) and phases 500. Exemplary power cables 1940 of illustrative embodiments may vary from ⅛" (3.175 mm) to ¼" (6.35 mm), though illustrative embodiments are not so limited. Depending on the cable diameter, the diameter and/or thickness of the pivoting retaining sleeves 200 and their associated ball sockets 210 may vary to maximize effectiveness. In an exemplary, non-limiting example phase 500 may have a diameter of ¼ inch (6.35 mm), pivoting retaining sleeve ball 205 may have a radius of about 0.245" (6.223 mm), and sleeve 200 may be about 1.260" (3.2 cm) in length. In this example, pothead assembly 250 may be about 4.2 inches (10.668 cm) in length.

Figure 5:
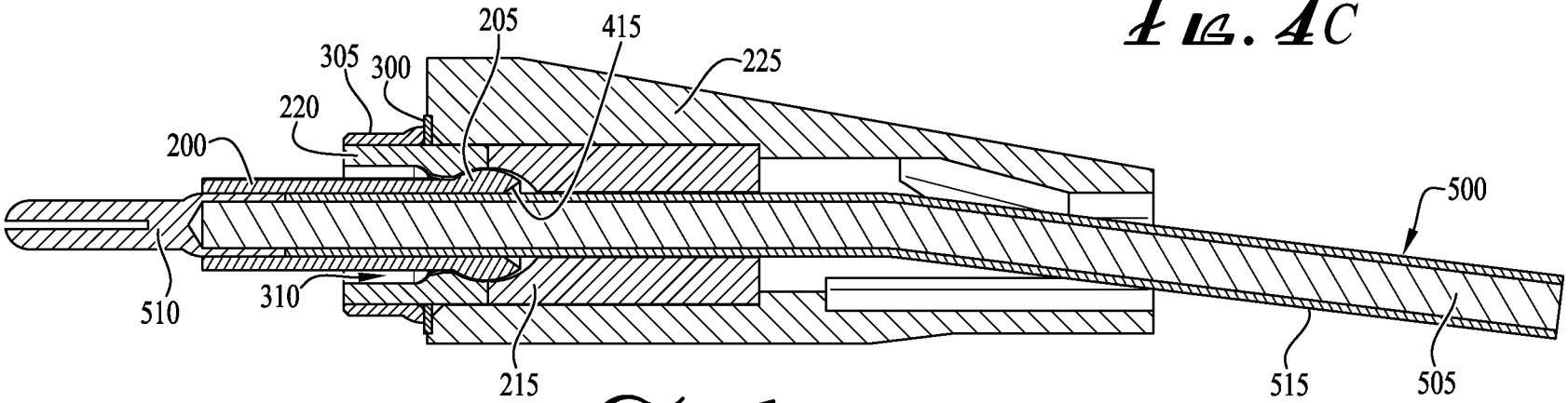
FIG. 5 illustrates a cross-sectional view across line 5-5 of FIG. 18 of a pothead assembly of illustrative embodiments including an exemplary cable phase and terminal pin.

Ball 205 and/or axial opening 405 may include cutout 415, as illustrated in FIG. 4C. Cutout 415 may be a notch, angling outward and/or clearance around opening 405 extending through the top of ball 205. Cutout 415 may ensure that as retaining sleeve 200 pivots with phase 500 extending through opening 415 of retaining sleeve 200, retaining sleeve 200 does not cut into phase 500 and/or retaining sleeve does not otherwise damage phase 500. FIG. 5 illustrates a cross-sectional view of the pothead assembly 250 including phase 500 extending through pothead 250 and retaining sleeve 200. Conductor 505 of phase 500 terminates at terminal pin 510. Cable insulation 515 may terminate prior to terminal pin 510 to allow conductor 505 to contact terminal pin 510. Cutout 415 provides a clearance around phase 500 as phase 500 extends through ball 205, to permit retaining sleeve to rotate without piercing phase 500.

Figure 7:
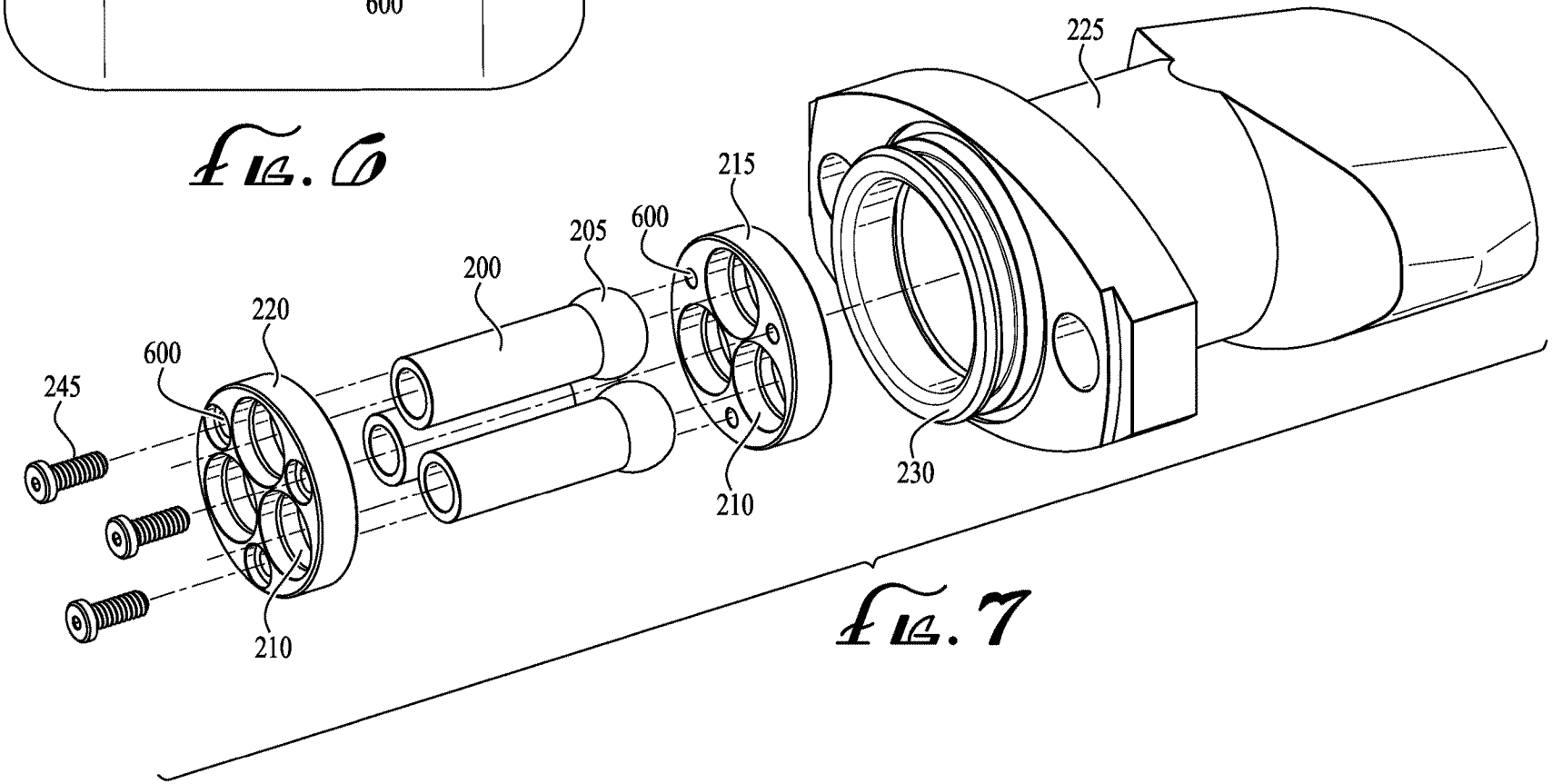
FIG. 7 illustrates an exploded view of a pothead assembly with three pivoting retaining sleeves of an illustrative embodiment.
Figure 6:
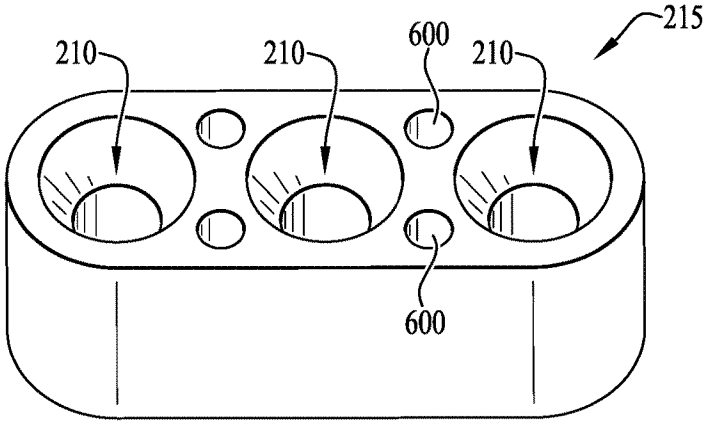
FIG. 6 illustrates a perspective view of a lower insulator having ball joint sockets of an illustrative embodiment.
Figure 8:
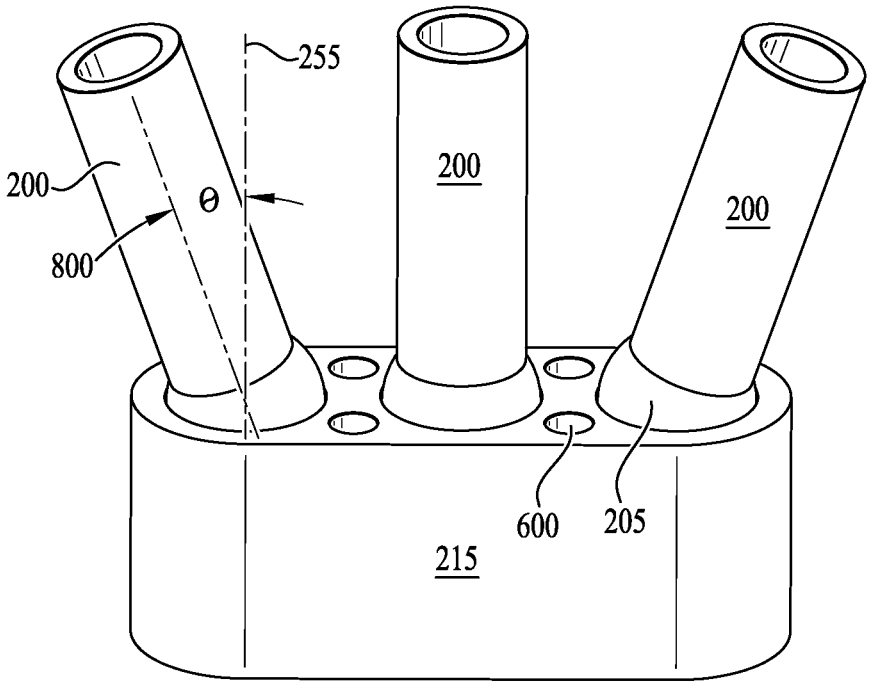
FIG. 8 illustrates a perspective view of a plurality of pivoting retaining sleeves installed in a lower insulator of an illustrative embodiment.

FIG. 6 illustrates an orthogonal view of a pothead upper insulator showing ball joint sockets of an illustrative embodiment. Upper insulator 215 may have a variety of cross-sectional shapes such as elliptical or round. The portion of socket 210 formed by upper insulator 215 is shown. Apertures 600 may be for compression screws 245 to attach upper insulator 215 to lower insulator 220 when pothead 250 is assembled. In round phase 500 configurations, upper insulator 215 may have a circular or similarly rounded cross-section as shown in FIG. 7, for example. Whether sleeves 200 are in a round, side-by-side, or other configuration, retaining sleeves 200 of illustrative embodiments may operate in a substantially similar manner. As shown in FIG. 7, sockets 210 and/or conduits extending through upper insulating block 215 and lower insulating block 220 may extend through the insulating blocks 215, 220 from a first face through to the opposing face of each block 215, 220. In FIG. 8, three pivoting retaining sleeves 200 are shown in a side-by-side configuration in an elliptically-shaped insulating block 215 that may be installed into pothead housing 225.

Each phase 500 of a motor 1935 (shown in FIG. 19) powered by cable 1940 may require one pivoting retaining sleeve 200. Upper insulator 215 may have the rounded and/or spherical ball socket (cavity) 210 or a portion thereof for each of the pivoting retaining sleeves 200 as illustrated in FIG. 8. In some embodiments, for ease of illustration and so as not to obscure illustrative embodiments, this description assumes a three-phase embodiment, though illustrative embodiments are not so limited. Thus, upper insulator 215 of FIG. 8 shows three ball sockets 210. Each insulating block 215, 220 may form a portion, one-half, or about one-half the space that forms socket 210, receives ball joint 205 and/or provides the common center 235 around which ball joint 205 may pivot. The other portion of socket 210 may be formed in lower insulator 220. The ball sockets 210 in upper insulator 215, lower insulator 220 and/or a combination thereof, are of largely identical and sufficient size to encompass ball joint 205, with enough tolerance to allow ball joint 205 to rotate and/or pivot as described herein.

FIG. 8 illustrates three pivoting retaining sleeves 200 installed in upper insulator 215 of an illustrative embodiment. Central axis 255 may be a line parallel to the axial direction of the retaining sleeve 200 and/or the longitudinal direction through pothead 250. Angle θ may indicate a cone 800 of rotation around central axis 255 with angle θ being an angle of offset from central axis 255. Cone 800 may proscribe the degrees of freedom of each pivoting retaining sleeve 200. Where tubular portion 400 of retaining sleeve 200 abuts lower insulating block 220 or skirt seal 230 when angled, angle θ may be about 20°, 30°, 35° or 40° from central axis 255. Once positioned at about angle θ from central axis 255, retaining sleeve 200 may pivot, rotate, and/or swivel along cone 800 and/or may be repositioned through yaw, pitch or roll, as needed. Each of the pivoting retaining sleeves 200 may rotate independently of one another, such that an installer may push two sleeves 200 in one direction and a third may be pulled in another, creating room for the installer to tie-in each phase 500 of power cable 1940 one phase 500 at a time. Sleeves 200 may move independently from one another, each sleeve 200 rotating in a distinct direction.

Figure 9:
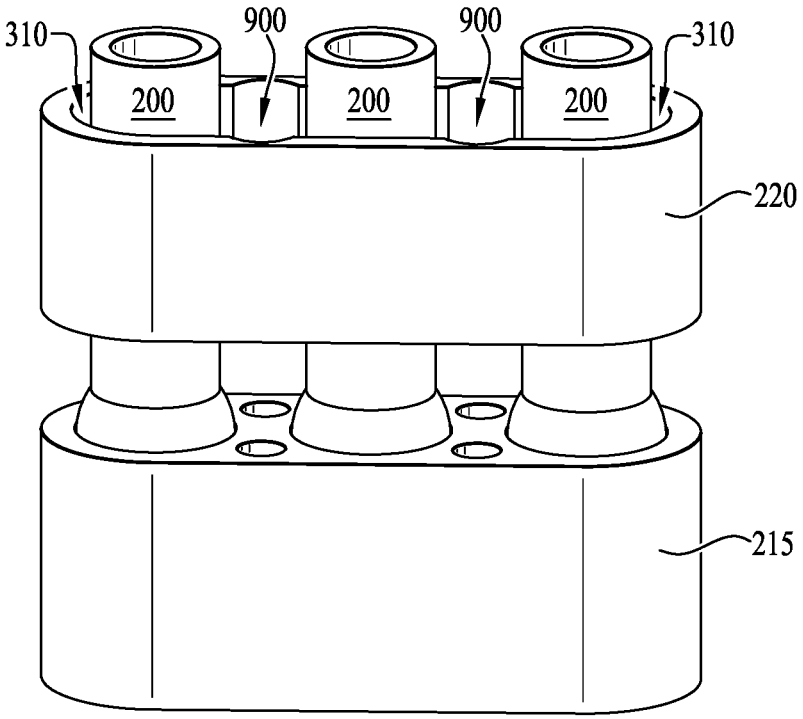
FIG. 9 illustrates a perspective view of placement of an upper insulator over a plurality of pivoting retaining sleeves of an illustrative embodiment.

FIG. 9 illustrates placement and/or sliding of lower insulator 600 over a plurality of ball joint retaining sleeves 200. Lower insulator 220 may have elongate openings 900 of sufficient diameter to accommodate retaining sleeve 200, including pivoting of retaining sleeve as sleeve 200 leans in response to pivoting of ball joint 205. In side-by-side embodiments with three phases 500, the center retaining sleeve 200 may have an elongate opening 900 on each side and/or clearance 310 may extend between the inner diameter of lower insulating block 220 and the outer diameter of retaining sleeve 200. Lower insulator 220 may also include ball socket 210, the lower portion of ball socket 210 and/or a cylindrical opening terminating in a portion of ball socket 210, to accommodate retaining sleeve 200 and/or the lower portion of ball joint 205, with tolerances 240 to allow for independent rotation of each pivoting retaining sleeve 200 as described above. In some embodiments, elongate opening 900, tolerance 240 and/or clearance 310 may taper outwards (flare) at about 35° to allow pivoting retaining sleeve 200 to rotate on ball joint 320 a sufficient angle θ without obstruction to create room for installation of phases 500 into motor head 1700.

Figure 10:
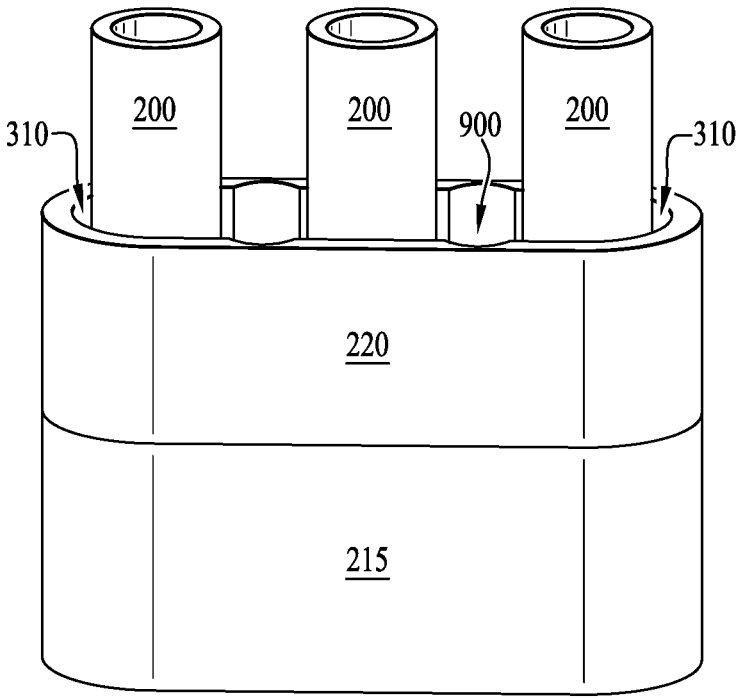
FIG. 10 illustrates a perspective view of a plurality of pivoting retaining sleeves extending through an upper and lower insulator of an illustrative embodiment.
Figure 11:
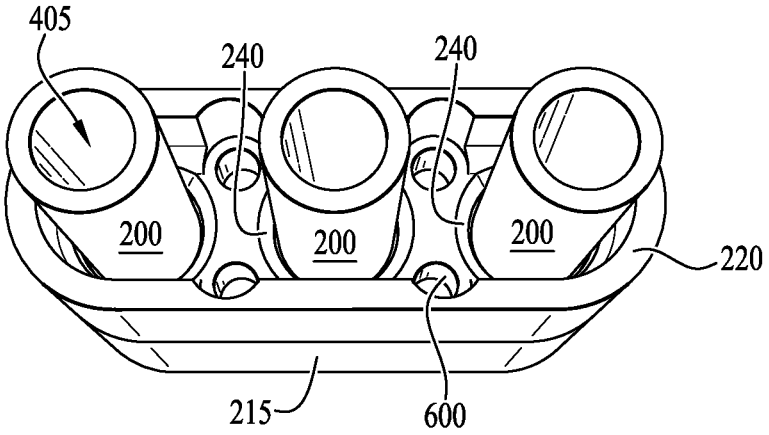
FIG. 11 illustrates a bottom view of a plurality of pivoting retaining sleeves encapsulated within an upper and lower insulator of an illustrative embodiment.

FIG. 10 illustrates a plurality of ball joint retaining sleeves 200 encapsulated within upper insulator 215 and lower insulator 220 of an illustrative embodiment. Retaining sleeves 200 may extend through conduits and/or pathways extending through insulators 215, 220, and phases 500 may extend through retaining sleeves 200. In this exemplar, all three pivoting retaining sleeves 200 may be parallel to central axis 255. Tolerance 240 around each retaining sleeve 200 and/or adjacent to the bottom of socket 210 is shown in FIG. 11, which is a bottom view of lower insulator 220. Tolerance 240 may permit retaining sleeve 200 to angle away from axis 255. Apertures 600 in insulators 215, 220 may accommodate compression screws 245 that hold upper insulator 215 and lower insulator 220 together after assembly with pivoting retaining sleeve 200. FIG. 11 illustrates the manner in which ball 205 may seat within socket 210 of upper insulator 215 and lower insulator 220, with lower insulator sliding around retaining sleeves 200 to complete socket 210. Compression screws 245 may be employed to compress upper insulator and lower insulator 200 encasing retaining sleeves 200, together.

Returning to FIGS. 3A and 3B, socket 210 around ball 205 of pivoting retaining sleeve 200 may be a gap and/or a circular or rounded space formed by one of upper insulator 215, lower insulator 220 or both. In some embodiments, socket 210 may be contiguous with a conduit through insulating blocks that accommodates tubular portion 400 of retaining sleeve 200 and/or phase 500. Socket 210 may accommodate ball 205 and provide ball 205 freedom to rotate around pivot point 235 through and around cone 800. Ball 205 and socket 210 joint may provide an angle θ around axis 255, such as up to 30-40° from axis 255, allowing pivoting retaining sleeve 200 to rotate, roll, pivot and/or otherwise move out of the way, with motion around central axis 255 and/or pivot point 235, to allow an installer to tie-in other power cable phases 500. Ball 205 in socket 210 may permit motion around three axes such as pitch, yaw and roll, with a common center (pivot point 235). The angle and/or size of tolerance 240, clearance 310, lower insulating block 220, seal skirt 230 and/or the ratio between the outer diameters of ball 205 and tubular portion 400, may determine the range of motion of ball 205 and socket 210 joint. FIG. 3B shows pivoting retaining sleeve 200 rotated out of the way by engaging ball 205 and socket 210 joint. Each phase 500 may be moved inside pivoting retaining sleeve 200 in such manner which may reduce stress on lower insulator 220, sleeve 200 and/or phase 500.

Figure 12:
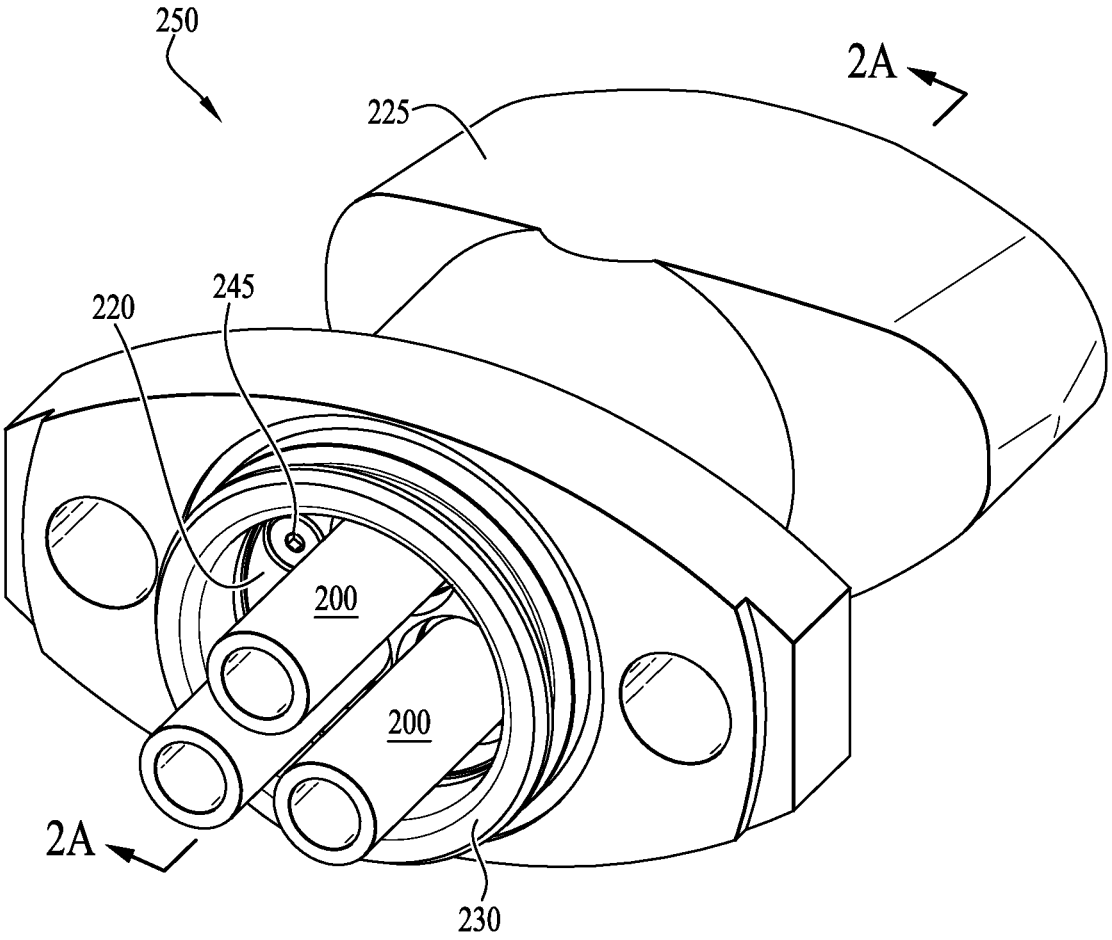
FIG. 12 illustrates an orthogonal view of a pothead assembly with three pivoting retaining sleeves of an illustrative embodiment in a round configuration.
Figure 13:
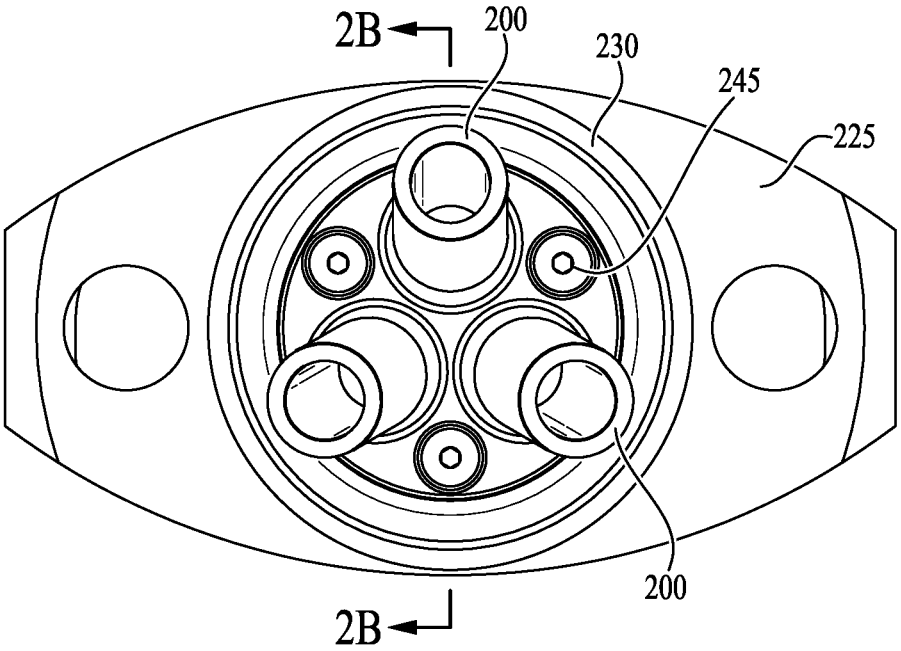
FIG. 13 illustrates a bottom view of a pothead assembly with three retaining sleeves pivoted outward in an illustrative embodiment.

Turning to FIG. 12, a "round" and/or in this instance where three phases 500 are employed, triangular configuration of phases 500 is shown in a round lower insulator 220, with all three pivoting retaining sleeves 200 parallel to axis 255. In the embodiment of FIG. 12, pothead 250 may be sealed to motor head 1700 (shown in FIG. 17A) with elastomeric ring 260 (shown in FIG. 2A) placed around skirt seal 230. FIG. 13 illustrates a bottom view of the triangular and/or round phase configuration of FIG. 12 with retaining sleeves 200 pivoted outward from axis 255 in a configuration that may give maximum access to all three phases 500 at once. Because of pivoting retaining sleeves 200, reduced stress may be placed on phase 500 and/or lower insulator 220, in this configuration, which may best accommodate the tie-in process. As shown in FIG. 13, phases in the triangular and/or round configuration may pivot until skirt seal 230 obstructs further pivot of retaining sleeve 200 and/or until offset is no longer desired.

Figure 14:
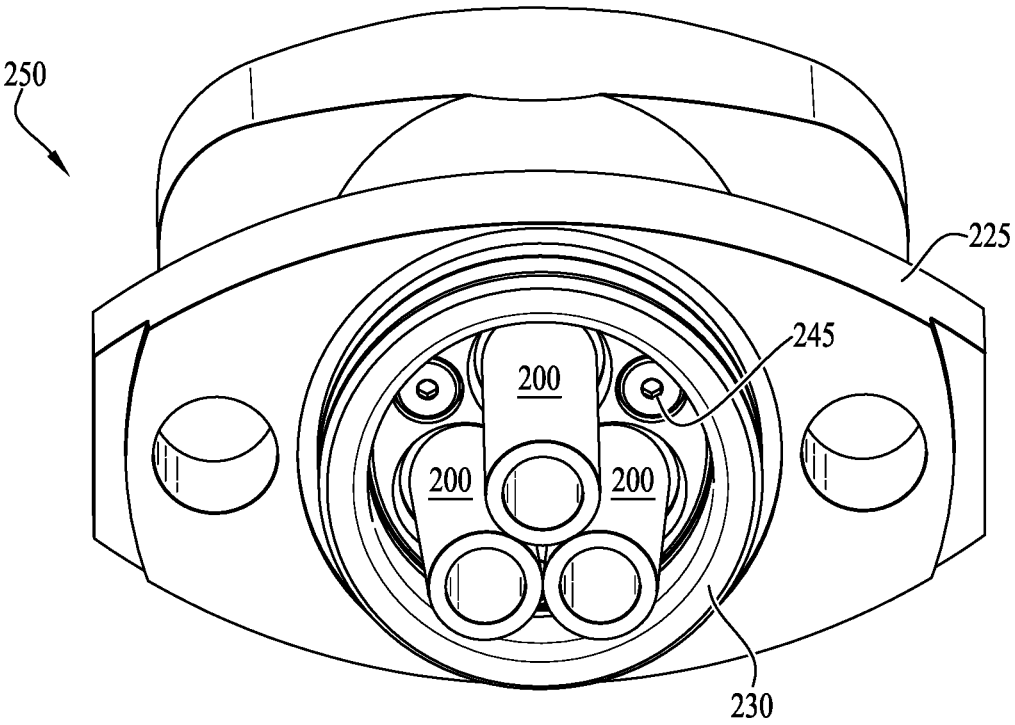
FIG. 14 illustrates an orthogonal view of a pothead assembly with all three retaining sleeves pivoted inward in an illustrative embodiment.
Figure 15A:
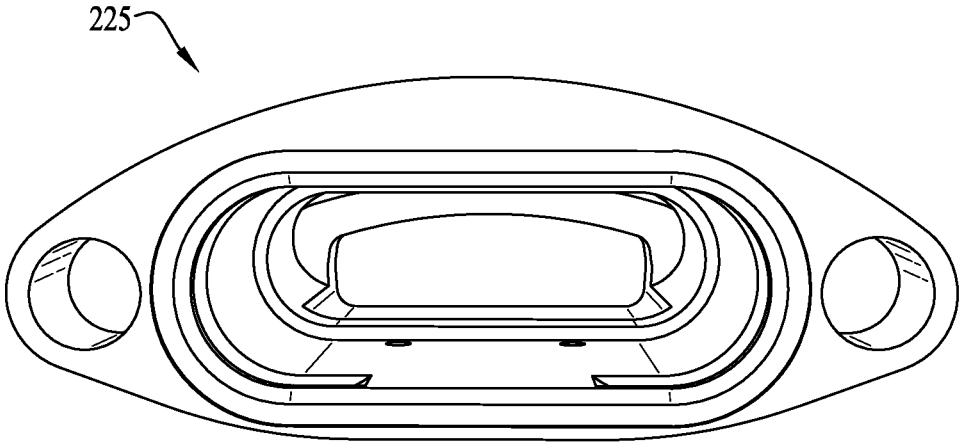
FIG. 15A-15B illustrate a pothead housing of an illustrative embodiment for a side-by-side configuration of phases.
Figure 15B:
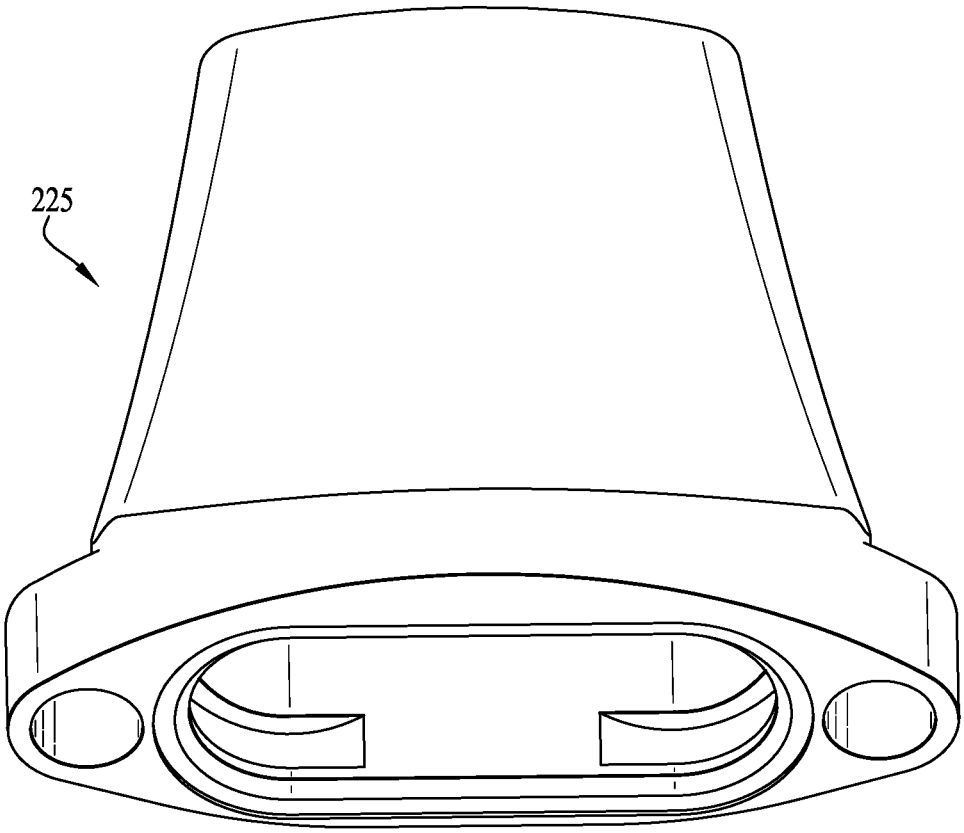

FIG. 14 illustrates an orthogonal view of pothead assembly 250 with all three retaining sleeves 200 pivoted inward in one embodiment of the invention. This configuration of pivoting retaining sleeves 200 may allow gathering all three phases 500 together for additional insulation wrapping, as well as making the connection compact and therefore easier to push into motor head 1700 during installation. FIGS. 15A-15B illustrate additional views of pothead housing 225 of an illustrative embodiment for an elliptical insulator 215, 220 and/or a linear (side-by-side) arrangement of phases 500.

Figure 16A:
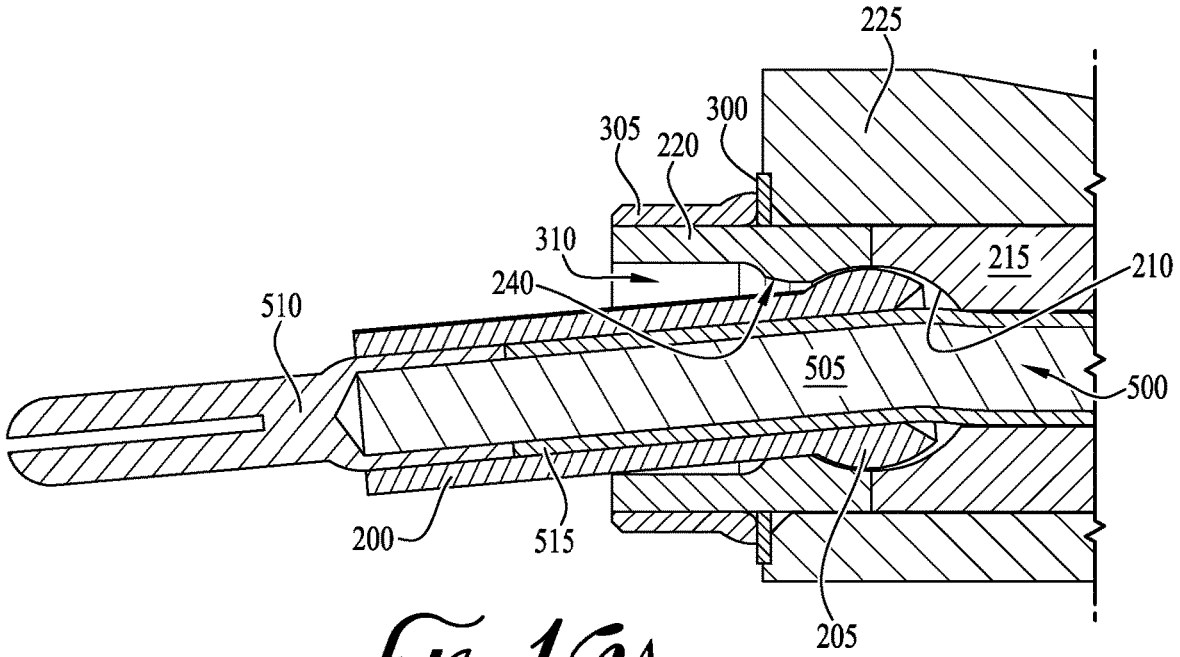
FIGS. 16A and 16B illustrate a cross-section of an exemplary pothead assembly showing a pivoting retaining sleeve with a cable and terminal pin of an illustrative embodiment.
Figure 16B:
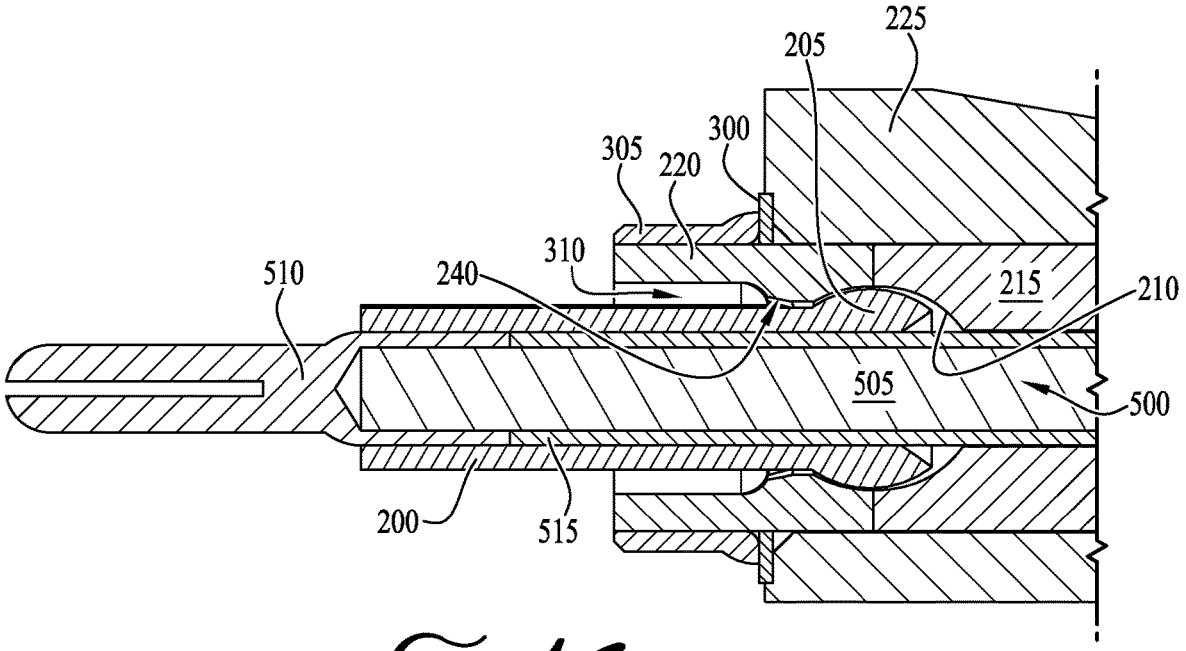

Turning to FIGS. 16A and 16B, a power cable phase 500 compatible with one or more embodiments of the invention may be an insulated electrical cable that includes conductor 505 surrounded by cable insulation 515. In some embodiments, the cable may contain multi-wire conductors 505 each wrapped in its own insulation 515 and then bound together as phase 500. Each motor lead extension (MLE) 1975 (shown in FIG. 19) may include three phases 500 for a three-phase, squirrel cage induction motor 1935. Conductor 505 may be copper or aluminum, for example. Cable insulation layer 515 may for example be Ethylene Propylene Diene Monomer (EPDM), rubber, polypropylene, polyethylene, or similar high temperature polymeric elastomer. In a three phase motor, such as ESP induction motor 1935, three phases 500 may be included in pothead assembly 250 of illustrative embodiments. Insulation layer 515 of power cable 1940 may be surrounded by an extruded lead sheath and/or armor (not shown) to protect cable insulation as it extends the length of ESP assembly 1900 downhole. A lead sheath and/or armor may terminate prior to extension and/or passing of phase 500 through retaining sleeve 200. Conducting pins 510 may extend from electrical conductor 505 and transfer current to motor 1935 through corresponding electrical receptacles in motor head 1700. Pivoting retaining sleeves 200 of illustrative embodiments may enclose each phase 500 as it extends out the bottom of pothead 250, and may allow an installer to beneficially maneuver each phase 500 during phase 500 tie-in. FIGS. 16A and 16B illustrate a cross-section of pothead assembly 250 showing pivoting retaining sleeve 200 with phase 500 and terminal pin 510 of an illustrative embodiment, with FIG. 16A in a pivoted orientation and FIG. 16B with phases 500 in a parallel orientation.

Figure 17A:
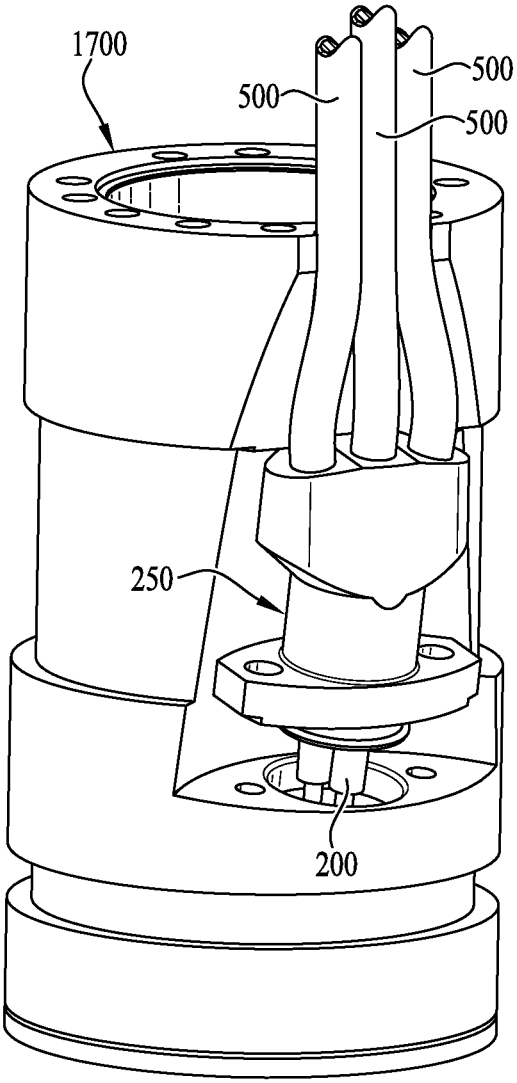
FIGS. 17A-17B are perspective views of a pothead of an illustrative embodiment being installed into a motor head.
Figure 17B:
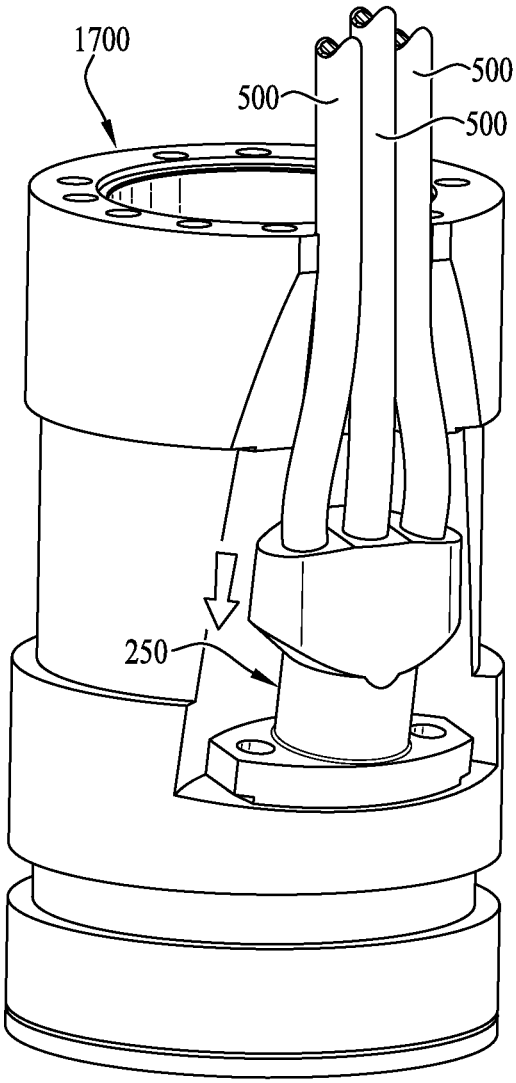
Figure 18:
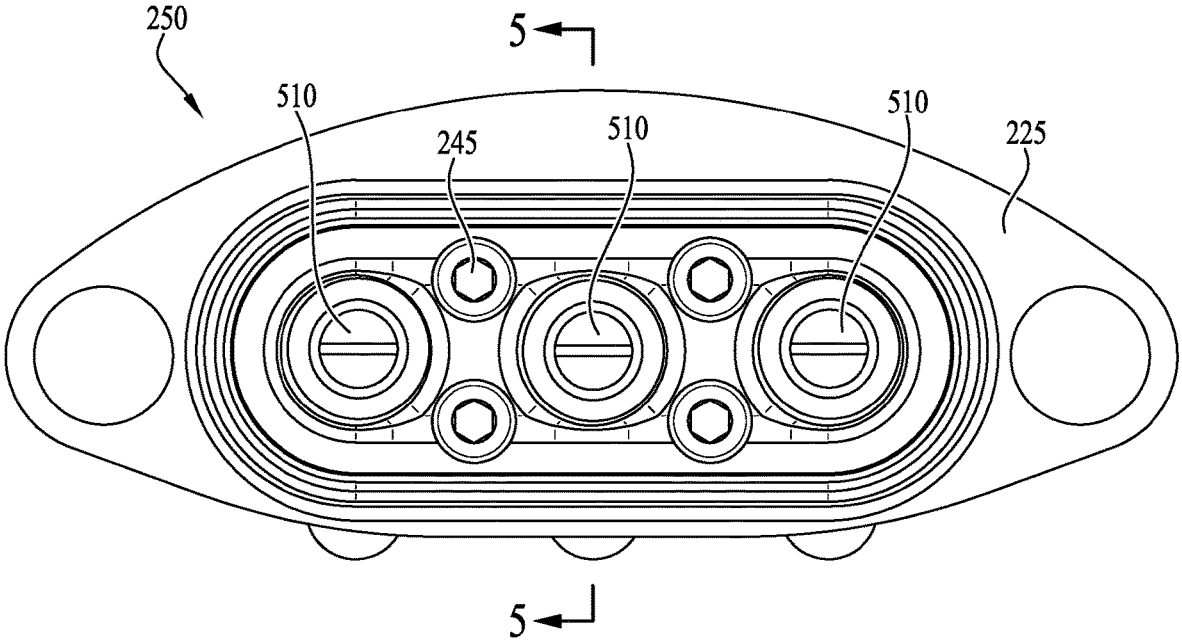
FIG. 18 illustrates a planar view of a pothead assembly with terminal pins of an illustrative embodiment.

A method of installing the three-phase power cable 1940 into the ESP motor head 1700 includes the steps of splicing a three-phase power cable 1940 and/or MLE 1975 to expose three separate phases 500 of power cable 1940. Next, the installer may place the terminating end of each phase 500, one at a time, into the central conduit and/or top of socket 210 opening of upper insulator 215 within pothead housing 225; passing each phase 500, one at a time, through ball joint 205 at one end of pivoting retaining sleeve 200 and continuing on through tubular portion 400 of pivoting retaining sleeve 200 thereby passing through lower insulator 220. To create enough space to connect the terminating end of a first phase 500 to a terminal connector of ESP motor head 1700, the installer may bend the terminating ends of a second and third phase 500 away from the first phase 500 by pivoting the corresponding retaining sleeves 200, for example up to 35° from central axis 255. When the space is ready, the installer may connect the terminating end of the first phase 500 to a first terminal connector of ESP motor head 1700. Next, the installer may tie the terminating end of the first phase 500 to the first terminal connector of ESP motor head 1700 by wrapping the connection in insulating material, such as, for example, Kapton® (a registered trademark of E. I. du Pont de Nemours and Company, a U.S. Delaware corporation) tape. This method is repeated by creating a space, connecting and tying the terminating ends for each of the second and third phases 500 and/or any additional phases 500 in turn until all phases 500 are tied to ESP motor head 1700. Finally, the installer pushes pothead assembly 250 into motor head 1700 and seals pothead 250 to motor head 1700 connection with an O-ring or similar elastomeric retaining mechanism. FIG. 17A and FIG. 17B illustrate pothead 250 assembly having pothead housing 225 of an illustrative embodiment inserted into motor head 1700. FIG. 18 illustrates a plan view of a pothead assembly 250 with terminal pins 155 installed of an illustrative embodiment. When all phases 500 are installed with their conductor 505 and terminal pins 510, pothead assembly 250 may appear as seen in FIG. 18.

Figure 19:
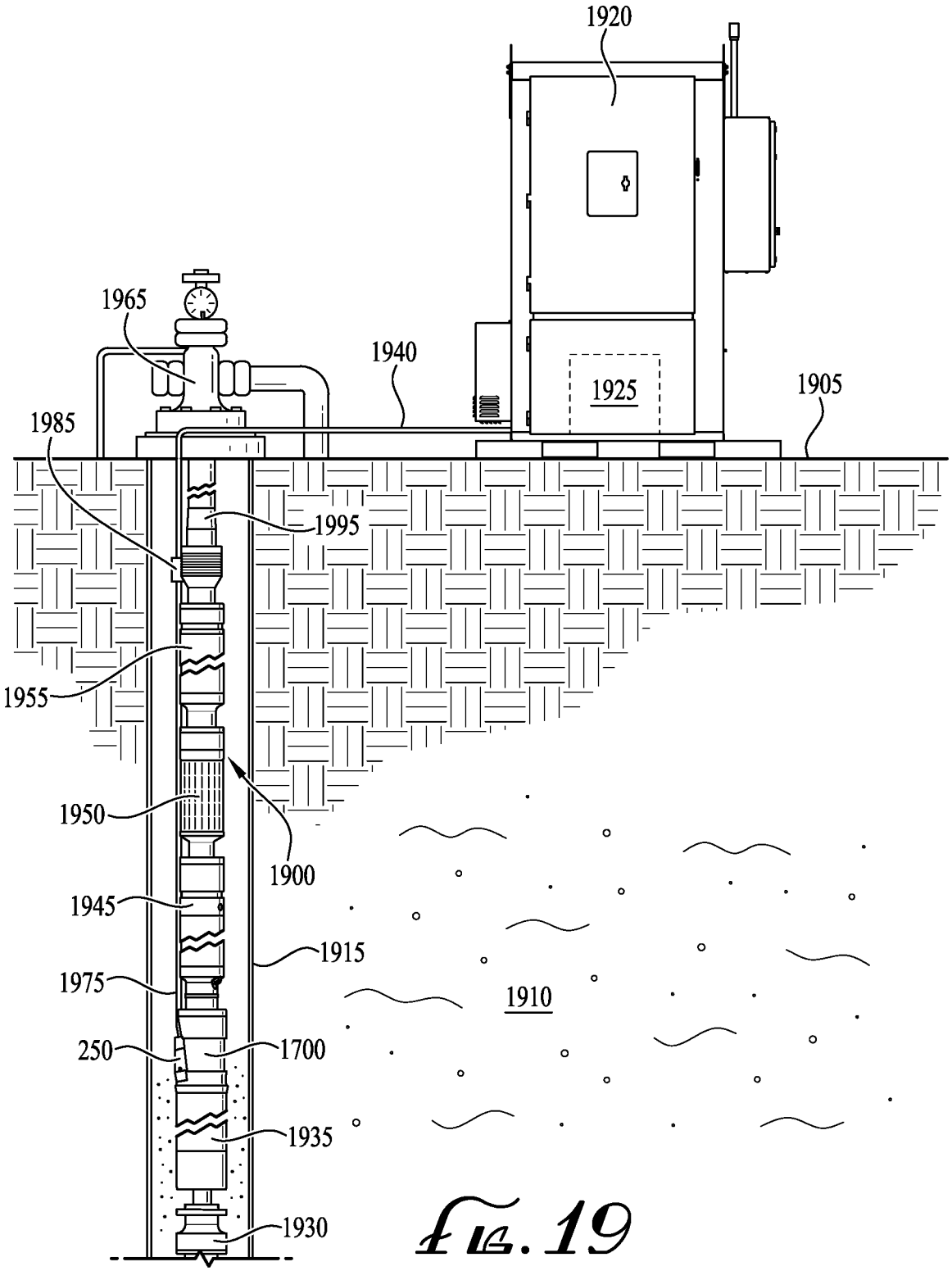
FIG. 19 is a perspective view of an electric submersible pump (ESP) assembly employing a pothead of an illustrative embodiment.

FIG. 19 illustrates an ESP assembly having a pothead retaining sleeve of an illustrative embodiment. ESP assembly 1900 may be located downhole in a well below surface 1905 and may extend, for example, several hundred or a few thousand feet deep. ESP assembly 1900 may be vertical, horizontal or may be curved, bent and/or angled, depending on well direction. The well may be an oil well, water well, and/or well containing other hydrocarbons, such as natural gas, and/or another production fluid from underground formation 1910. ESP assembly 1900 may be separated from underground formation 1910 by well casing 1915. Production fluid may enter well casing 1915 through casing perforations (not shown). Casing perforations may be either above or below ESP intake 1950.

ESP assembly 1900 may include, from bottom to top, downhole sensors 1930 which may detect and provide information such motor speed, internal motor temperature, pump discharge pressure, downhole flow rate and/or other operating conditions to a user interface, variable speed drive controller and/or data collection computer in cabinet 1920. ESP motor 1935 may be an induction motor, such as a two-pole, three phase squirrel cage induction motor. Power cable 1940 may provide power to ESP motor 1935 and/or carry data from downhole sensors 1930 to surface 1905. ESP cabinet 1920 at surface 1905 may contain a power source 1925 to which power cable 1940 connects. Downstream of motor 1935 may be motor protector 1945, ESP intake 1950, multi-stage centrifugal ESP pump 1955 and production tubing 1995. Motor protector 1945 may serve to equalize pressure and keep the motor oil separate from well fluid. ESP intake 1950 may include intake ports and/or a slotted screen and may serve as the intake to centrifugal ESP pump 1955. ESP pump 1955 may be a multi-stage centrifugal pump including stacked impeller and diffuser stages. Other components of ESP assemblies may also be included in ESP assembly 1900, such as a tandem charge pump (not shown) or gas separator (not shown) located between centrifugal ESP pump 1955 and intake 1950 and/or a gas separator may serve as the pump intake. Shafts of motor 1935, motor protector 1945, ESP intake 1950 and ESP pump 1955 may be connected together (i.e., splined) and be rotated by motor 1935. Production tubing 1995 may carry lifted fluid from the discharge of ESP pump 1355 towards wellhead 1965.

Power cable 1940 may extend from power source 1925 at surface 1905 to motor lead extension (MLE) 1975. Cable connection 1985 may connect power cable 1940 to MLE 1975. MLE 1975 may plug in, tape in, spline in or otherwise electrically connect power cable 1940 to motor 1935 to provide power to motor 1935. Pothead assembly 250 may enclose the electrical connection between MLE 1975 and head 1700 of motor 1935. Power cable 1940 may deliver power to motor 1935 through electric conductor 505 making up one or more motor phases 500.

A pothead retaining sleeve apparatus, system and method has been described. Illustrative embodiments may provide pivoting of the retaining sleeves during installation providing space to tie-in the power cable phases, such as the connections in an ESP assembly. Illustrative embodiments may provide an improved ability to install the phases into the motor head without creating undue stress on the phase cables and/or insulating blocks.

Further modifications and alternative embodiments of various aspects of the invention may be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the scope and range of equivalents as described in the following claims. In addition, it is to be understood that features described herein independently may, in certain embodiments, be combined.

The invention claimed is:

1. An electric submersible motor pothead comprising:

a pair of insulating blocks comprising a first insulating block adjacent to a second insulating block, each pair of insulating blocks comprising a conduit for each phase of a plurality of phases of a power cable;

each conduit comprising a socket formed partially by the first insulating block and partially by the second insulating block;

a phase retaining sleeve extending through each conduit, the phase retaining sleeve comprising a ball seated in the socket; and the phase retaining sleeve pivotable in the socket around the ball.

2. The electric submersible motor pothead of claim 1, wherein the phase retaining sleeve is pivotable by pitch, yaw and roll around the ball.

3. The electric submersible motor pothead of claim 1, wherein the phase retaining sleeve further comprises a tubular portion coupled to the ball, and a channel extending through the ball and the tubular portion of the phase retaining sleeve.

4. The electric submersible motor pothead of claim 3, wherein a power cable phase of the plurality of phases extends through the channel, the power cable phase powering an electric submersible motor.

5. The electric submersible motor pothead of claim 4, wherein the channel at a top of the ball comprises a cutout around the power cable phase.

6. The electric submersible motor pothead of claim 1, wherein each conduit further comprises a tolerance extending from the socket, the tolerance accommodating angling of the phase retaining sleeve inside the pair of insulating blocks.

7. The electric submersible motor pothead of claim 6, wherein the tolerance comprises a flared inner diameter of one of the first insulating block or the second insulating block.

8. The electric submersible motor pothead of claim 6, wherein the tolerance comprises a space around a tubular portion of the phase retaining sleeve.

9. The electric submersible motor pothead of claim 1, wherein each phase retaining sleeve is independently pivotable.

10. The electric submersible motor pothead of claim 1, wherein the conduits are arranged in a triangular configuration and the pair of insulating blocks are round in cross-section.

11. The electric submersible motor pothead of claim 10, further comprising a pothead housing, the pothead housing comprising a seal skirt extending below the pair of insulating blocks.

12. The electric submersible motor pothead of claim 1, wherein the conduits are arranged in a side-by-side configuration and the pair of insulating blocks are elliptical.

13. An electric submersible motor pothead system comprising:

a pothead for electrically connecting a power cable to an electric submersible motor, the power cable comprising a plurality of phases, each phase of the plurality of phases extending through a retaining sleeve;

the retaining sleeve extending through a conduit formed through an insulating block secured inside the pothead, the conduit comprising a substantially spherical socket;

the retaining sleeve comprising a tubular portion and a ball at an end of the tubular portion, the ball seated within the substantially spherical socket to form a ball and socket joint; and the tubular portion rotatable inward and outward around the ball and socket joint during tying off of the plurality of phases.

14. The electric submersible motor pothead system of claim 13, wherein each phase of the power cable comprises a conductor surrounded by a cable insulation layer, wherein the conductor is electrically coupled to a conducting pin that plugs into an electric submersible motor.

15. The electric submersible motor pothead system of claim 14, wherein the electric submersible motor is downhole and is operable to turn an electric submersible pump, and wherein the power cable extends from a power source proximate a well surface to the electric submersible motor to provide power to the electric submersible motor.

16. The electric submersible motor pothead system of claim 13, wherein the ball is a spherical segment, and the substantially spherical socket is rounded to mate with the spherical segment.

17. The electric submersible motor pothead system of claim 16, wherein a diameter of the spherical segment is larger than a diameter of the tubular portion.

18. The electric submersible motor pothead system of claim 17, wherein a ratio of the diameter of the spherical segment to the diameter of the tubular portion is 1.23:1 and the retaining sleeve is rotatable outwards up to 35°.

19. The electric submersible motor pothead system of claim 13, wherein the retaining sleeve is pivotable by pitch, yaw and roll around the ball.

20. A method of installing a three-phase power cable into an electric submersible pump (ESP) motor head, comprising:

splicing the three-phase power cable to expose three separate phases;

placing a terminating end of each phase, one at a time, into a central conduit of an upper insulator within a pothead;

passing each phase, one at a time, through a ball joint at one end of a pivoting retaining sleeve and continuing on through an axial portion of the pivoting retaining sleeve thereby passing through a lower insulator;

creating a space to connect the terminating end of a first phase of the three separate phases to a terminal connector of the ESP motor head by bending the terminating ends of a second and third phase away from the first phase by pivoting the pivoting retaining sleeve up to 35° from a central axis passing through a center of the pivoting retaining sleeve;

connecting the terminating end of the first phase to a terminal connector of the ESP motor head;

tying the terminating end of the first phase to the terminal connector of the ESP motor head by wrapping the connection in insulating material;

repeating creating a space, connecting, and tying the terminating end steps for each of the second and third phases in turn until all three phases are tied to the ESP motor head;

pushing the pothead into the ESP motor head; and sealing the pothead to motor head connection.

* * * * *